US006322378B1

(12) United States Patent
Auclair

(10) Patent No.: US 6,322,378 B1
(45) **Date of Patent: *Nov. 27, 2001**

(54) CONDUCTOR PROTECTOR FOR GROUND CLAMP

(75) Inventor: William T. Auclair, Winsted, CT (US)

(73) Assignee: Electric Motion Company, Inc., Winsted, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/461,103

(22) Filed: Dec. 14, 1999

(51) Int. Cl.[7] ..... H01R 13/648
(52) U.S. Cl. ..... 439/99; 439/98
(58) Field of Search ..... 439/98, 793, 812, 439/609, 99

(56) References Cited

U.S. PATENT DOCUMENTS 4,571,013 * 2/1986 Suffi et al. ..... 339/14 R
4,895,525 * 1/1990 Leonardo ..... 439/99
5,722,840 * 3/1998 Auclair et al. ..... 439/98

* cited by examiner

*Primary Examiner*—Paula Bradley
*Assistant Examiner*—Ann McCamey
(74) *Attorney, Agent, or Firm*—Alix, Yale & Ristas, LLP

(57) ABSTRACT

A conductor protector for providing crush resistant support to the conductors in a cable and implementing a ground connection between the metallic shield of a cable and a common ground point employs an elongated, trough-like member composed of electrically conductive, structurally rigid material particularly adapted for use in conjunction with cable shield ground clamps. Conductive extensions project from one end of the conductor protector to provide a conductive path between the cable shield and a location exterior of the cable jacket, eliminating the need to remove the jacket prior to assembly into a ground clamp.

24 Claims, 5 Drawing Sheets

CONDUCTOR PROTECTOR FOR GROUND CLAMP

BACKGROUND OF THE INVENTION

This invention relates generally to devices for implementing a ground connection between a metallic shield of a cable and a common ground point. More particularly, the present invention relates to clamp devices which mount to service cables and connect via a flexible or rigid conductor with a common ground point.

Service cables, which may be buried underground or suspended above ground, are typically constructed in a tubular fashion with numerous thin metal conductors or pairs of conductors surrounded by a conductive ground shield. The shield is in turn surrounded by a protective jacket of tough, flexible plastic or rubber. The conductive shield of a service cable is intended to prevent electromagnetic fields and lightning from penetrating the cable and interfering with signals being transmitted on the conductors. To function properly and safely, cable shields must be grounded at spaced ground points established by regulations and/or operational specifications and practices. The invention generally relates to clamp assemblies adapted to create and maintain such ground connections.

In applications to which the present invention relates, the clamp assemblies are ordinarily positioned within a cabinet, housing or other enclosure (hereafter collectively termed "enclosure") to provide a grounding connection between the metallic shield of the service cable/s and a common ground point. Such enclosures are frequently located outdoors and/or underground where the enclosures and their contents are subjected to intense environmental changes. For example, it is not uncommon for the enclosure to heave as a result of frost while the service cables are frozen in position in the ground. Moisture in the form of rain, ground water or condensation is also frequently present within the enclosure.

U.S. Pat. No. 5,429,532 discloses one type of cable shield ground clamp to which the present invention generally relates. The clamp is constructed of a generally U-shaped yoke. A keeper has a driver which threadably engages threaded surfaces on the inside of the yoke legs. The keeper has a clamp jaw which may be compressively engaged against a cable shield or shields received in an aperture defined by the yoke. The yoke then connects to a common ground point via a flexible ground wire connection.

As cables are tightened within such a clamp, damage can occur to the conductors within the cable or to the shield surrounding the conductors, or both. It is known in the art to install protective devices within such cable shield/ground clamp assemblies to prevent damage to the cable conductors. U.S. Pat. No. 5,722,840 discloses one type of conductor protector to which the present invention generally relates. The conductor protector takes the form of a protective shoe that may be inserted between the conductors and the cable clamp jaw to prevent crushing of the inner conductors. The protective shoe is an elongated semi-sleeve-like or trough-like member composed of electrically conductive material and having a longitudinally extending channel. The cable may be placed in the channel of the shoe or the shoe may be inserted within the shield. In either configuration, the shoe partially surrounds the inner conductors. The cables are then placed within the clamp and the jaw is tightened. As the jaw compresses the cables, the rigidity of the shoe provides crush resistance while allowing the clamp to be tightened to ensure a mechanical engagement of high integrity.

To install the protective shoe disclosed in U.S. Pat. No. 5,722,840, the protective jacket must be removed from the cable to ensure a proper electrical connection between the cable's conductive ground shield and the ground clamp. While introduction of the conductor protector disclosed in U.S. Pat. No. 5,722,840 presented a significant improvement over industry practice and provided crush resistance and strain relief not previously available, those skilled in the art will recognize that there are drawbacks to removal of the protective jacket. Removal of the protective jacket presents new avenues for moisture to penetrate the cable. Loss of the linear strength and abrasion resistance of the protective jacket weakens the cable and the resulting cable shield/ground clamp assembly. In addition, the process of jacket removal involves scoring around the cable with a sharp knife, often resulting in nicks or cuts in the underlying shield, thus weakening the shield. Such weakened shields are prone to failure and consequent loss of ground continuity. Furthermore, removal of the jacket adds a step to the labor required to install a cable shield/ground clamp assembly.

SUMMARY OF THE INVENTION

Briefly stated, the invention in a preferred form is a conductor protector for providing crush resistant support for conductors while maintaining cable ground shield continuity in service cable shield/ground clamp assemblies. The conductor protector is an elongated, trough-like member composed of electrically conductive, structurally rigid material. A longitudinally extending channel allows the conductor protector to surround and partially enclose the conductors. A first end of the conductor protector is tapered to facilitate inserting the conductor protector between the conductors and the shield or between the shield and the outer protective jacket. At least one extension of the trough-like member integrally projects from the opposed end and extends toward the first end to define a generally U-shaped structure adjacent to the exterior surface of the conductor protector. The extension provides a conductive path from the cable shield to a location exterior of the cable protective jacket, eliminating the need to remove the protective jacket prior to assembly into a ground clamp. The extension also aids in properly longitudinally positioning the conductor protector within the cable.

An object of the invention is to provide a new and improved conductor protector for use in a service cable ground connection.

Another object of the invention is to provide a conductor protector which ensures the integrity of the ground shield and conductors while implementing a high strength connection.

A further object of the invention is to provide a conductor protector having an efficient construction which may be installed in an efficient and low cost manner.

A yet further object of the invention is to provide a conductor protector that defines a conductive path from the conductive shield of a cable to a location exterior of the cable jacket without necessitating removal of the jacket.

Other objects and advantages of the invention will become apparent from the specification and the drawings.

DETAILED DESCRIPTION OF THE PREFERRED EMBODIMENTS

Figure 11:
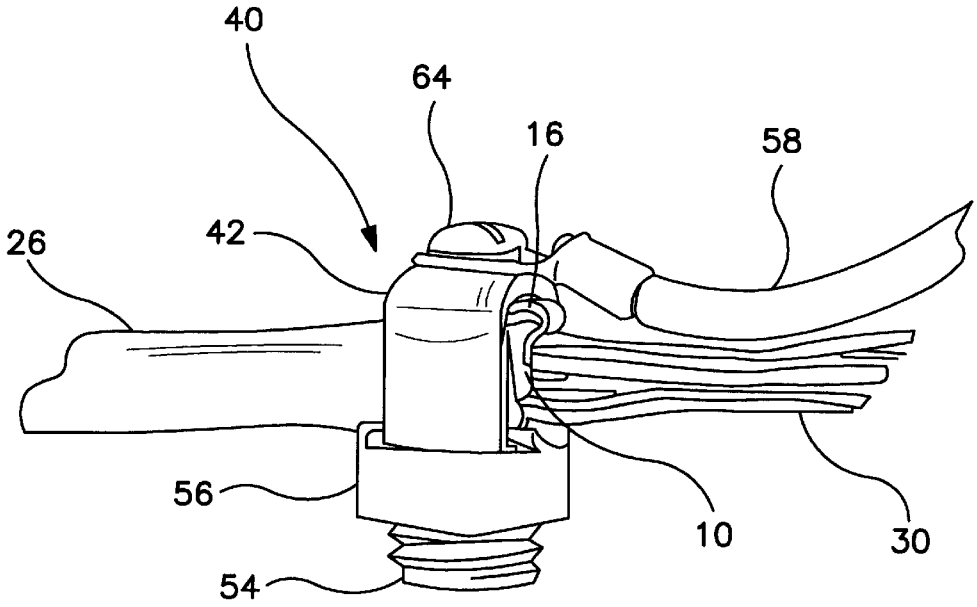
FIG. 11 is a perspective view of the conductor protector/service cable assembly of FIG. 10 rotated 180° and installed in a ground clamp in accordance with the present invention (service cables and ground wire partially illustrated)

With reference to the drawings wherein like numerals represent like parts throughout the figures, conductor protectors in accordance with the present invention are generally designated by the numerals 10 and 10'. Conductor protectors 10, 10' in accordance with the invention are adapted to be inserted into a service cable 26, having at least one conductor 30, a conductive shield 32 and a protective jacket 28. The conductor protectors are used in cable shield/ground clamp assemblies (FIGS. 11 and 13) which are ordinarily positioned within enclosures (not illustrated). Multiple service cables 26 typically enter an enclosure where their conductive shields 32 must be electrically connected to a common ground point. Conductor protectors 10, 10' of the present invention are adapted to partially surround and protect the portion of the conductors 30 of service cables 26 which are tightened within a cable shield/ground clamp assembly, while providing strain relief and shield to ground continuity.

Figure 10:
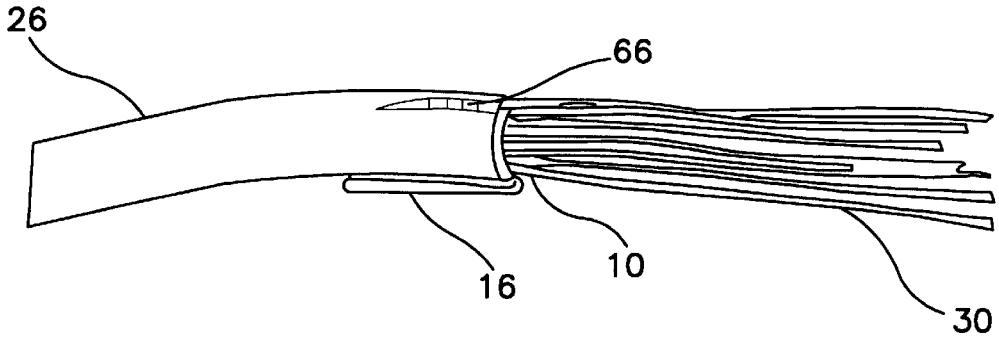
FIG. 10 is a perspective view of the conductor protector of FIG. 1 installed in a service cable (partially illustrated) in accordance with the present invention.
Figure 12:
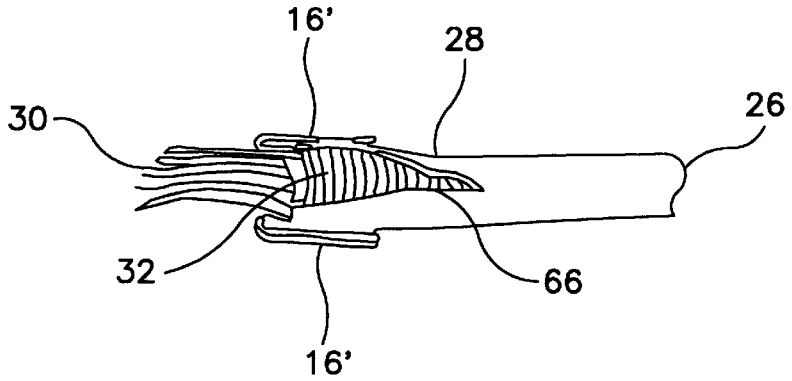
FIG. 12 is a perspective view of the conductor protector of FIG. 5 installed in a service cable (partially illustrated) in accordance with the present invention.

The conductor protector 10, 10' is an elongated, trough-like member composed of electrically conductive, structurally rigid material. A first end 12 of the conductor protector 10, 10' is tapered to facilitate its insertion into the cable 26. Each conductor protector 10 has a longitudinal channel 24 adapted for partially surrounding the conductor pairs 30. Conductor protectors are provided with at least one extension 16, 16' projecting integrally from a second end 14. Upon insertion into a cable 26, as shown in FIGS. 10 and 12, the extensions 16 and 16' provide a conductive path from the cable shield 32 to a location external of the cable protective jacket 28.

With reference to FIGS. 1–4, a conductor protector 10 has a single extension 16 projecting integrally from the second end 14. The extension 16 projects toward the first end 12, defining a generally U-shaped structure adjacent to the outer arcuate surface 20 of the conductor protector 10. A conductor protector 10' having two extensions 16' projecting integrally from the second end is shown in FIGS. 5–8. The extensions 16, 16' project toward the first end defining generally U-shaped structures adjacent to the outer arcuate surface 20 of the conductor protector 10'.

Figure 1:
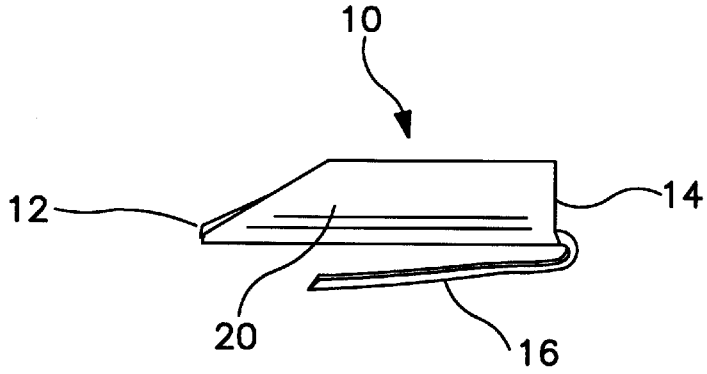
FIG. 1 is a side view of a conductor protector in accordance with the present invention.
Figure 2:
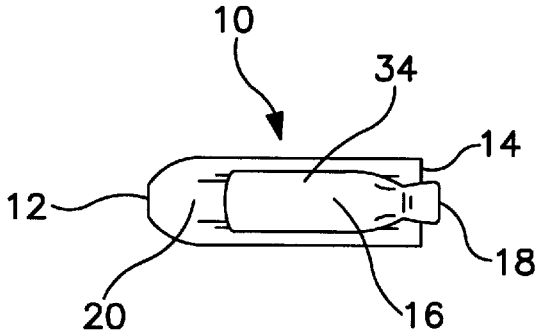
FIG. 2 is a bottom view of the conductor protector of FIG. 1.
Figure 3:
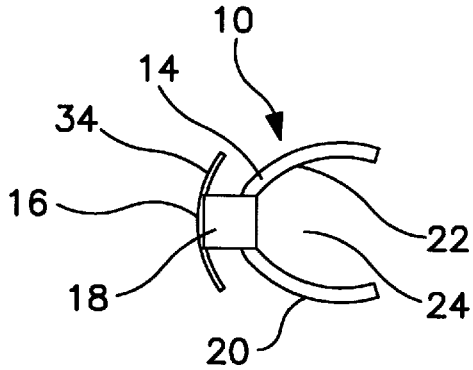
FIG. 3 is an end view of the conductor protector of FIG. 2 viewed from the right.
Figure 4:
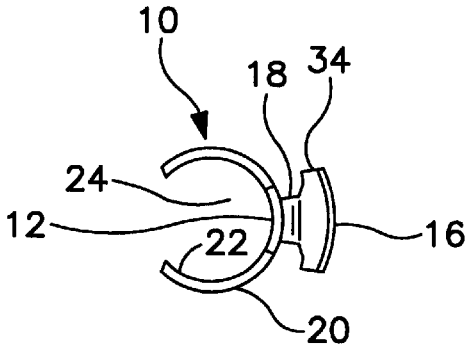
FIG. 4 is an end view of the conductor protector of FIG. 2 viewed from the left.
Figure 5:
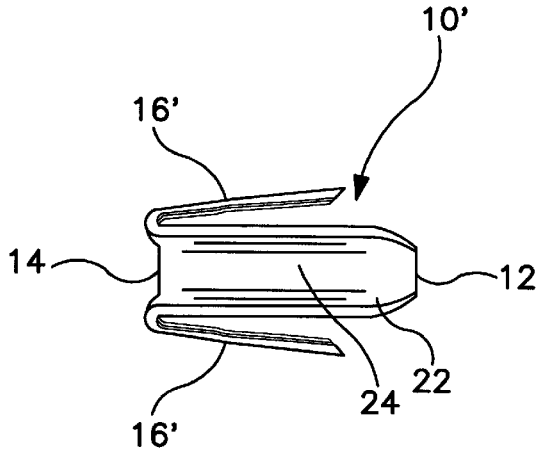
FIG. 5 is a top view of a second embodiment of a conductor protector in accordance with the present invention.
Figure 6:
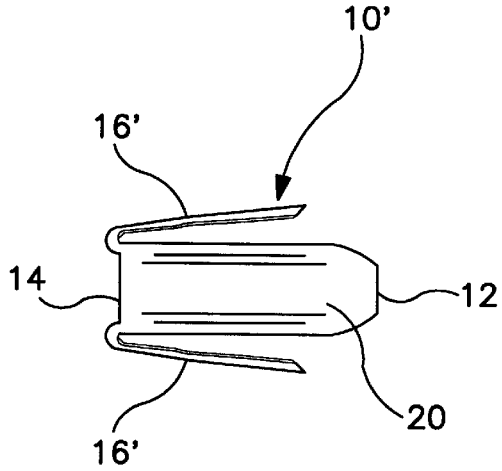
FIG. 6 is a bottom view of the conductor protector of FIG. 5.
Figure 7:
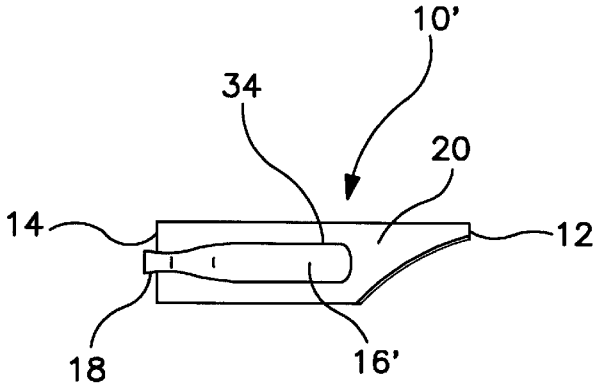
FIG. 7 is a side view of the conductor protector of FIG. 6.
Figure 8:
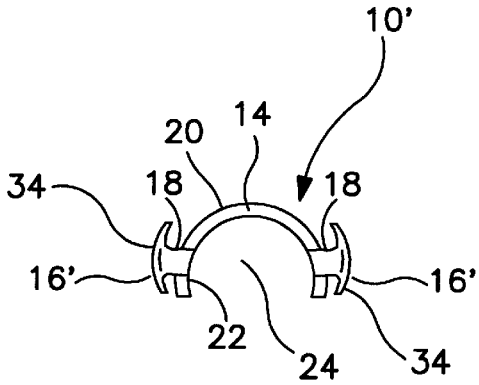
FIG. 8 is an end view of the conductor protector of FIG. 7 viewed from the left.

In a preferred configuration, extensions 16, 16' are thin paddle-shaped structures, having narrow first 18 and laterally expanded second 34 portions. As shown in FIGS. 2, 3, 4, 7 and 8, the narrow first portion 18 is integrally connected to the second end 14, and the second portion 34 projects toward the first end 12 of the conductor protector 10, 10'. The extensions 16, 16' preferably project a distance greater than half but less than the entire length of the member. The second portion 34 of the extensions 16, 16' has a longitudinally arcuate surface with a curvature similar to the curvature of the outer arcuate surface. This feature is best seen in FIGS. 3, 4 and 8. The increased width of the second portion 34 presents an increased surface area for electrical connection to the ground clamp 40 or adjacent extensions 16' in multiple cable assemblies. The curved profile of the expanded second portion 34 of the extensions 16, 16' allows the second portion 34 to conform to the shape of the exterior of the cable 26 and the interior of the yoke 42 and keeper 56 of the ground clamp 40, enhancing ease of assembly.

Figure 9:
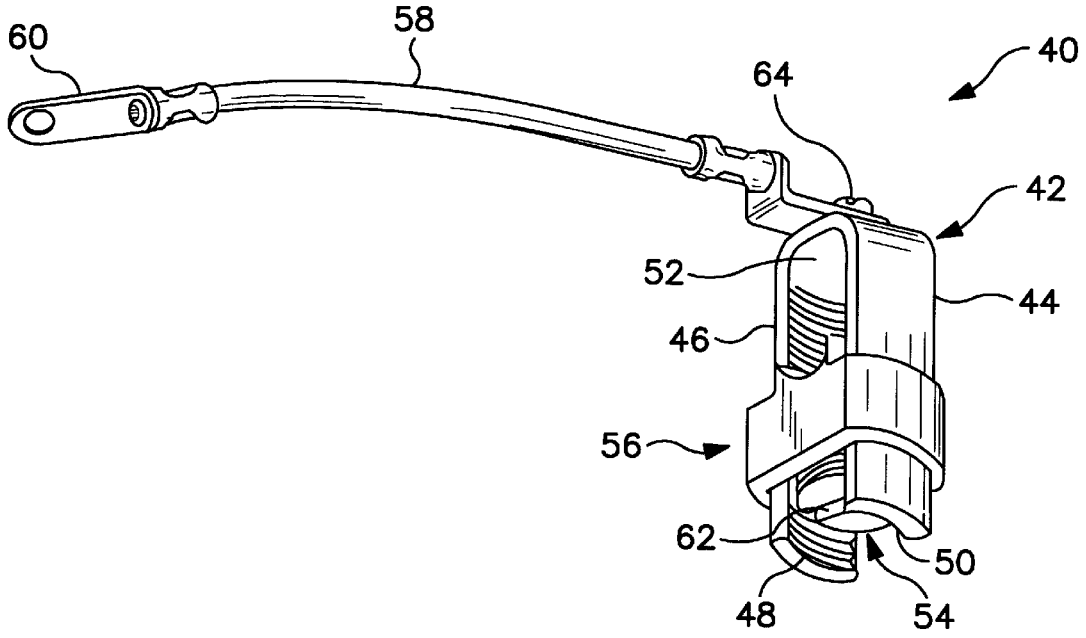
FIG. 9 is a perspective view of a ground clamp for which the conductor protectors of FIGS. 1–8 have particular applicability.

Conductor protectors 10, 10' of the present invention are adapted for use with numerous ground clamps and ground connectors and particularly with ground clamps 40 of a type illustrated by FIG. 9. The ground clamp 40 comprises a generally U-shaped yoke 42, having generally parallel legs 44, 46. The legs 44, 46 of the yoke 42 have opposed inwardly disposed thread surfaces 48, 50. A receiving aperture 52 is generally formed at the upper inward portion of the yoke 42 for receiving one or more service wire ground shields 32. A set screw 64 which may be any of numerous conventional forms is threaded at the upper cap of the yoke for anchoring the flexible ground wire 58 or other suitable grounding connector. Ground wire 58 is typically six inch No. 6 or No. 10 AWG lead wire and the wire terminal 60 is connected to a ground stud (not illustrated). The ground shields 32 are compressively secured to the ground clamp 40 by means of a keeper 56, which is slidably displaceable and selectably fixedly positionable along the legs 44, 46 of the yoke 42.

Figure 13:
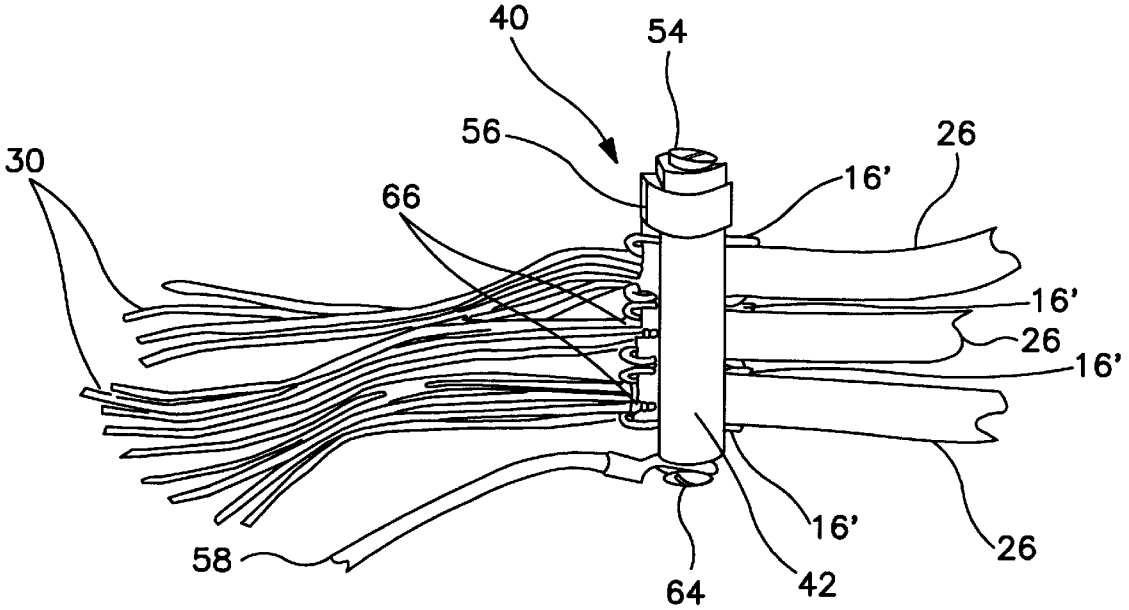
FIG. 13 is a perspective view of multiple conductor protector/service cable assemblies, as illustrated in FIG. 12, assembled in a ground clamp in accordance with the present invention (service cables and ground wire partially illustrated).

The conductor protector 10 of FIGS. 1–4 is intended for use in cable shield/ground clamp assemblies containing a single service cable. As illustrated in FIG. 10, a conductor protector 10 having a single extension 16 will create contact with the metal surface of the yoke 42 or keeper 56 of the ground clamp 40. In cable shield/ground clamp assemblies having more than one service cable, the preferred embodiment 10', illustrated in FIGS. 5–8 can be used. As illustrated in FIG. 13, the dual extensions 16' of this embodiment provide electrically conductive paths from cable 26 to adjacent cable 26 as well as conductive paths between the shields 32 of the cables 26 and the ground clamp 40. Multiple cables 26 may be installed in the same ground clamp 40 where extensions 16' abut each other and the clamp surfaces thereby creating a conductive path traversing the cable shields 32 and the cable shield ground clamp 40. The extensions 16' engage in surface-to-surface relationship along a substantial interface to ensure and maintain a continuous and reliable ground path.

Service cables having thin metal conductors or fiber optic conductors can be problematic to ground without damaging the fragile conductors. The inner conductors are susceptible to crushing when the clamping mechanism is tightened. If the clamping mechanism is left loose to avoid crushing the conductors, loss of ground continuity or failure of the assembly may result. A conductor protector 10, 10' in accordance with the invention may be installed either between the conductor pairs 30 and the conductive shield 32 thereby engaging the interior surface of the conductive shield 32 with the outer arcuate surface 20 the conductor protector 10, 10' or the conductor protector 10, 10' can be installed between the conductive shield 32 and the protective jacket 28 thereby engaging the exterior surface of the cable shield with the inner arcuate surface of the conductor protector 10, 10'.

In either of these arrangements, a ground path from the ground shield 32 traverses through the extensions 16, 16' disposed exteriorly of the protective jacket 28. In either configuration, the rigidity of the conductor protectors 10, 10' and their location between the conductors 30 and the ground clamp 40 allow the conductor protectors to protect the conductors 30 even when the ground clamp 40 is securely tightened.

Either embodiment of the present invention can be used without removal of the protective jacket 28 of a service cable 26. As shown in FIGS. 10 and 12, a lengthwise slit 66 is made in the protective jacket 28 to accommodate insertion of the conductor protector 10, 10'. According to a preferred embodiment of the invention, the jacket 28 remains intact and continues to protect the conductive shield 32 and to provide strain relief and moisture resistance to the cable 26. The invention allows the protective jacket 28 to remain intact while providing a conductive path from the conductive shield 32 to a point exterior of the protective jacket 28.

A conductor protector according to the invention allows the creation of a ground connection implemented by a cable shield/ground clamp assembly of high clamping integrity without compromising shield to ground continuity while also ensuring the integrity of the shield and the conductors. The conductor protectors are also easy to install and reduce installation costs by eliminating conventional steps in the grounding process.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A conductor protector for a cable of a type having a ground clamp, the cable having at least one conductor surrounded by a conductive shield and a protective jacket, the conductor protector comprising:

an elongated trough-like member composed of electrically conductive material having opposite first and second ends and inner and outer arcuate surfaces, said trough-like member being adapted for surrounding a majority of the circumference of said at least one conductor and defining a longitudinally extending channel extending from said first end to said second end and having a first lateral width, and at least one extension integrally formed and connected to said second end, said at least one extension including a first portion adjacent said second end having a second width that is less than said first lateral width, said extension defining an electrically conductive path from said member to a location radially spaced from said outer arcuate surface.

2. The conductor protector of claim 1 wherein the trough-like member is of substantially rigid construction.

3. The conductor protector of claim 1 wherein said extension projects toward said first end in spaced relationship to said outer arcuate surface, thereby defining a generally U-shaped structure.

4. The conductor protector of claim 1 wherein the trough-like member has two extensions integrally connecting at said second end, each said extension adjacent to said longitudinally extending channel at opposite locations of the outer arcuate surface.

5. The conductor protector of claim 1 wherein said trough-like member first end is tapered.

6. The conductor protector of claim 1 wherein said member has a length and said extension projects from said second end a distance greater than one half but less than the length of said member.

7. The conductor protector of claim 1 wherein said extension has a paddle-shaped configuration, comprising a second portion extending from said first portion, said second portion having a third width greater than said second width but less than said first lateral width.

8. The conductor protector of claim 7 wherein said outer arcuate surface has a curvature and said second portion comprises an arcuate structure having a curvature similar to said outer arcuate surface.

9. A cable protector assembly comprising:

a cable comprising at least one conductor, an outer jacket, and a conductive shield intermediate said conductor and said jacket; and a conductor protector disposed intermediate said outer jacket and said conductor, said conductor protector comprising an elongated member composed of electrically conductive material having opposite first and second ends and inner and outer arcuate surfaces, said member surrounding a majority of the circumference of said at least one conductor and defining and longitudinally extending channel extending from said first end to said second end and having a first lateral width, and at least one extension integrally formed and connected to said second end, said extension including a first portion adjacent said second end having a second width that is less than said first lateral width, said extension defining an electrically conductive path from said member to a location radially spaced from said outer arcuate surface;

wherein said conductor protector is in conductive contact with said shield.

10. The cable protector assembly of claim 9 wherein said conductor protector has two extensions integrally connecting at said second end, each said extension adjacent to said longitudinally extending channel at opposite locations of the outer arcuate surface.

11. The cable protector assembly of claim 9 wherein said trough-like member is of substantially rigid construction.

12. The cable protector assembly of claim 9 wherein said channel is sized for closely receiving said cable.

13. The cable protector assembly of claim 9 wherein said member first end is tapered.

14. The cable protector assembly of claim 9 wherein said extension projects toward said first end in spaced relationship to said outer arcuate surface, thereby defining a generally U-shaped structure.

15. The cable protector assembly of claim 14 wherein said conductor protector is inserted between said conductor and said shield, said shield and said jacket disposed between the extension and the member.

16. The cable protector assembly of claim 14 wherein said conductor protector is inserted between said shield and said jacket, said jacket disposed between the extension and the member.

17. The cable protector assembly of claim 14 wherein said member has a length and said extension projects from said second end a distance greater than one half and less than the length of the member.

18. The cable protector assembly of claim 9 wherein said extension has a paddle-shaped configuration comprising a second portion extending from said first portion, said second portion having a third width greater than said second width but less than said first lateral width.

19. The cable protector assembly of claim 18 wherein said outer arcuate surface has a curvature and said extension has a longitudinally arcuate structure with a curvature similar to said outer arcuate surface curvature.

20. A conductor protector for a cable of a type having a ground clamp, the cable having at least one conductor surrounded by a conductive shield and a protective jacket, the conductor protector comprising:

an elongated trough-like member composed of electrically conductive, structurally rigid material having opposite first and second ends and inner and outer arcuate surfaces, said trough-like member being adapted for surrounding a majority of the circumference of said at least one conductor and defining and longitudinally extending channel traversing said inner and outer surfaces and extending from said first end to second end;

insertion means at said first end for facilitating insertion of said member into a cable; and ground path means for defining an electrically conductive path from said member to a location radially spaced from said outer arcuate surface, said ground path means comprising a paddle-shaped extension, said extension including a narrow first portion integrally extending from said second end and an enlarged second portion extending from said first portion.

21. A conductor protector for a cable of the type having a ground clamp, the cable having at least one conductor surrounding by a conductive shield and a protective jacket, the conductor protector comprising:

an elongated trough-like member composed of electrically conductive material having opposite first and second ends and inner and outer arcuate surfaces, said trough-like member configured to surround a majority of the circumference of the conductor and defining a channel longitudinally extending from said first end to said second end; and two extensions integrally formed and connected to said second end, each said extension defining an electrically conductive path from said member a location radially spaced from said outer arcuate surface, said extensions connecting at angularly spaced locations on said second end.

22. The conductor protector of claim 21, wherein said angularly spaced locations are separated by an angle of approximately 180°.

23. A cable protector assembly comprising:

a cable comprising at least one conductor, an outer jacket, and a conductive shield intermediate said conductor and said jacket; and a conductor protector disposed intermediate said outer jacket and said conductor, said conductor protector comprising:

an elongated trough-like member composed of electrically conductive material having opposite first and second ends and inner and outer arcuate surfaces, said trough-like member configured to surround a majority of a circumference of said at least one conductor and defining a channel longitudinally extending from said first end to said second end; and two extensions integrally formed and connected to said second end, each extension defining an electrically conductive path from said member to a location radially spaced from said outer arcuate surface, said extensions connecting at angularly spaced locations on said second end, wherein said conductor protector is in conductive contact with said shield.

24. The conductor protector of claim 23, wherein said angularly spaced locations are separated by an angle of approximately 180°.

* * * * *

UNITED STATES PATENT AND TRADEMARK OFFICE

CERTIFICATE OF CORRECTION

PATENT NO. : 6,322,378 B1
DATED : November 27, 2001
INVENTOR(S) : Auclair

It is certified that error appears in the above-identified patent and that said Letters Patent is hereby corrected as shown below:

Column 6,
Line 37, after "defining" change "and" to -- a --.

Column 7,
Line 27, after "defining" change "and" to -- a --.

Signed and Sealed this

Fifth Day of November, 2002

*Attest:*

*Attesting Officer*

JAMES E. ROGAN
*Director of the United States Patent and Trademark Office*